US008939097B2

(12) United States Patent
Suzuki

(10) Patent No.: US 8,939,097 B2
(45) Date of Patent: Jan. 27, 2015

(54) THREADING DEVICE FOR SEWING MACHINE LOWER LOOPER

(71) Applicant: Jaguar International Corporation, Osaka (JP)

(72) Inventor: Yoshikazu Suzuki, Osaka (JP)

(73) Assignee: Jaguar International Corporation, Osaka (JP)

( * ) Notice: Subject to any disclaimer, the term of this patent is extended or adjusted under 35 U.S.C. 154(b) by 35 days.

(21) Appl. No.: 13/871,692

(22) Filed: Apr. 26, 2013

(65) Prior Publication Data

US 2013/0269579 A1 Oct. 17, 2013

(51) Int. Cl.

| | |
|---|---|
| ***D05B 57/00*** | (2006.01) |
| ***D05B 87/02*** | (2006.01) |
| *D05B 63/00* | (2006.01) |

(52) U.S. Cl.

CPC ..... *D05B 87/02* (2013.01); *D05B 63/00* (2013.01)

USPC ..... 112/199; 112/302

(58) Field of Classification Search

USPC ..... 112/55, 162, 166, 199, 200, 225, 302

See application file for complete search history.

(56) References Cited

U.S. PATENT DOCUMENTS

| | | | | | |
|---|---|---|---|---|---|
| 1,803,918 | A * | 5/1931 | Rozdilski | 112/225 |
| 4,977,842 | A * | 12/1990 | Fukao et al. | 112/199 |
| 5,076,181 | A * | 12/1991 | Wang | 112/199 |
| 5,327,841 | A * | 7/1994 | Sakuma | 112/162 |
| 5,347,941 | A * | 9/1994 | Mizuno | 112/199 |
| 7,011,032 | B1 * | 3/2006 | Chang | 112/200 |
| 8,100,068 | B2 * | 1/2012 | Suzuki | 112/225 |
| 2004/0149192 | A1 * | 8/2004 | Horiuchi | 112/199 |
| 2008/0236466 | A1 | 10/2008 | Sadasue | |

FOREIGN PATENT DOCUMENTS

| | | |
|---|---|---|
| JP | 61-012953 | 5/1983 |
| JP | 58-198385 | 11/1983 |
| JP | 05-032071 | 12/1987 |
| JP | 2608950 | 8/1990 |

OTHER PUBLICATIONS

International Search Report application No. PCT/JP2011/077399 dated Feb. 21, 2012 for related patent application.

* cited by examiner

*Primary Examiner* — Ismael Izaguirre
(74) *Attorney, Agent, or Firm* — Husch Blackwell? LLP

(57) ABSTRACT

A threading device for a sewing machine lower looper is disclosed that can thread a lower looper safely and reliably by reliably preventing a main shaft from rotating when an operation of threading the lower looper is carried out.

3 Claims, 6 Drawing Sheets

THREADING DEVICE FOR SEWING MACHINE LOWER LOOPER

TECHNICAL FIELD

The present invention relates to a threading device for a sewing machine lower looper that is equipped in a sewing machine for oversewing and that can thread the lower looper safely and reliably.

BACKGROUND ART

A conventional so-called overlock sewing machine that carries out overedging forms seams by combining a thread passed through the eye of a needle and a looper thread passed through the looper eye of a lower looper together. Therefore, in order to allow the looper thread to be picked up on a thread guide of the lower looper to be passed through the looper eye, it is necessary to operate a hand pulley until the looper eye and the thread guide of the lower looper are moved to a position adjacent to an opening on the front of the sewing machine and then to pick up the looper thread on the thread guide that has been moved to the position adjacent to the opening to pass it through the looper eye.

However, due to the relationship with respect to the stitch point of a sewing needle, it is impossible to move the lower looper to the position where the lower looper is exposed sufficiently from the opening. Therefore, it is necessary to carry out an operation of threading the lower looper in a small space and thus the operation of threading the lower looper is a troublesome operation, which has been a problem. Furthermore, there is also a possibility that when the lower looper is activated during a threading operation, the threading device for the lower looper may be damaged.

Therefore, for example, Patent Document 1 discloses a safety device for an overlock sewing machine that detects the position of the looper and can prevent the main shaft from rotating while a detection signal indicating that the looper is in an exposed position is being generated. Furthermore, Patent Document 2 discloses a threading device for a looper that prevents a pulley from rotating by inserting a locking arm into a catching part of the pulley so that the threading device is not damaged even when the sewing machine is started during a threading operation. This prevents the lower looper from operating even when the sewing machine is started by mistake. Thus, the threading device for a looper is not damaged by, for example, oscillation of the lower looper.

PRIOR ART DOCUMENTS

Patent Documents

[Patent Document 1] JP 05-032071 Y
[Patent Document 2] JP 61-012953 Y

SUMMARY OF THE INVENTION

Problem to be Solved by the Invention

However, in the safety device of the overlock sewing machine disclosed in Patent Document 1, it is necessary to carry out an operation of threading the looper while a detection signal indicating that the looper is in an exposed position is being generated. Furthermore, the configuration of the whole device is complicated and this causes the cost of the device to increase, which has been a problem. Moreover, the threading device for a looper disclosed in Patent Document 2 is prevented from being damaged even when the sewing machine is started during a threading operation, but an operation of inserting the locking arm into the catching part of the pulley is necessary independently from the threading operation. Therefore, a possibility still remains that the threading device for a looper may be damaged by, for example, oscillation of the lower looper when the sewing machine is started by mistake during the threading operation, with the insertion operation being forgotten to be carried out.

The present invention was made with such situations in mind and is intended to provide a threading device for a sewing machine lower looper that can thread the lower looper safely and reliably by reliably preventing a main shaft from rotating when an operation of threading the lower looper is carried out.

Means for Solving Problem

In order to solve the above-mentioned problems, a threading device for a sewing machine lower looper according to a first invention that passes a looper thread through a looper eye of the lower looper on the underside of a needle plate is characterized in that the threading device comprises: a first moving member with a threading member fixed to one end thereof, with the threading member having a hook part that can be inserted into the looper eye of the lower looper; a second moving member that is connected to the first moving member in such a manner as to be able to move in a direction opposite to that in which the first moving member moves, with an operating member being connected thereto on the same side as the hook part; and a lock lever having, in a lower part thereof, a convex part that engages with a groove of a groove cam attached to a main shaft and, in an upper part thereof, a protruding part that comes into contact with the operating member, and when the convex part of the lock lever engages with the groove, the operating member and the protruding part of the lock lever are separated from each other, which prevents movement of the second moving member from being restricted.

In the first invention, when the convex part of the lock lever engages with the groove of the groove cam attached to the main shaft, that is, with the main shaft being prevented from rotating, the operating member that pushes the second moving member in and the protruding part of the lock lever are separated from each other. Therefore, by pushing the operating member in, the second moving member is pushed in without the movement thereof being restricted. When the second moving member is pushed in, the first moving member that moves in the direction opposite to that in which the second moving member moves is pushed out and thereby the hook part is inserted into the looper eye of the lower looper. Accordingly, when an operation of threading the lower looper is carried out, the main shaft is prevented from rotating without fail. Thus, the lower looper threading device can be prevented from being damaged due to, for example, oscillation of the lower looper caused by the rotation of the main shaft. Furthermore, it is not necessary to detect the position of the lower looper and therefore it is enough for the whole device to have a simple configuration, which allows the cost of the device to be reduced.

A threading device for a sewing machine lower looper according to a second invention is characterized in that in the first invention, the lock lever is fixed in such a manner that one end thereof can move vertically, and when the other end is lowered, the convex part engages with the groove and thereby the operating member and the protruding part are separated from each other, which allows the second moving member to be capable of moving, and when the other end is lifted, the convex part is released from the groove and thereby the operating member and the protruding part come into contact with each other to restrict movement of the second moving member.

In the second invention, the lock lever is fixed in such a manner that one end thereof can move vertically. When the other end of the lock lever is lowered, the convex part engages with the groove and thereby the operating member and the protruding part are separated from each other, which allows the second moving member to be capable of moving. When the other end of the lock lever is lifted, the convex part is released from the groove and thereby the operating member and the protruding part come into contact with each other to restrict movement of the second moving member. Accordingly, when an operation of threading the lower looper is carried out, the main shaft is prevented from rotating without fail. Thus, the lower looper threading device can be prevented from being damaged due to, for example, oscillation of the lower looper caused by the rotation of the main shaft.

Furthermore, a threading device for a sewing machine lower looper according to a third invention that passes a looper thread through a looper eye of the lower looper on the underside of a needle plate is characterized in that the threading device comprises: a first moving member with a threading member fixed to one end thereof, with the threading member having a hook part that can be inserted into the looper eye of the lower looper; a second moving member that is connected to the first moving member in such a manner as to be able to move in a direction opposite to that in which the first moving member moves, with an operation dial capable of rotating being connected thereto on the same side as the hook part; and a lock lever that has, in a lower part thereof, a convex part that engages with a groove of a groove cam attached to a main shaft, that is fixed in such a manner that one end thereof can move vertically, that moves the other end vertically according to rotation of the operation dial, and that has the operation dial at an end thereof, the operation dial has a hole cam mechanism that is connected to the other end of the lock lever and can move the other end vertically, and the rotation of the operation dial allows the second moving member to move, with the convex part engaging with the groove.

In the third invention, by simply rotating the operation dial, the convex part of the lock lever can engage with the groove of the groove cam attached to the main shaft. In such an engaged state, that is, with the main shaft being prevented from rotating, the second moving member can be pushed in. When the second moving member is pushed in, the first moving member is pushed out and thereby the hook part is inserted into the looper eye of the lower looper. Accordingly, when an operation of threading the lower looper is carried out, the main shaft is prevented from rotating without fail. Thus, the lower looper threading device can be prevented from being damaged due to, for example, oscillation of the lower looper caused by the rotation of the main shaft. Furthermore, it is not necessary to detect the position of the lower looper and therefore it is enough for the whole device to have a simple configuration, which allows the cost of the device to be reduced.

Effects of the Invention

According to the present invention, when an operation of threading the lower looper is carried out, the main shaft is prevented from rotating without fail. Thus, the lower looper threading device can be prevented from being damaged due to, for example, oscillation of the lower looper caused by the rotation of the main shaft. Furthermore, it is not necessary to detect the position of the lower looper and therefore it is enough for the whole device to have a simple configuration, which allows the cost of the device to be reduced.

BEST MODE FOR CARRYING OUT THE INVENTION

Hereinafter, embodiments of a threading device for a sewing machine lower looper (hereinafter referred to as a "lower looper threading device 10") according to the present invention are described in detail with reference to the drawings. In the following descriptions, the Y-axis direction is a direction along the cloth feeding direction on a plane surface along a needle plate (hereinafter referred to as a "needle plate 100") of a sewing machine, the X-axis direction is a direction orthogonal to the cloth feeding direction, and the Z-axis direction is a direction perpendicular to the plane surface along the needle plate 100.

Embodiment 1

Figure 1A:
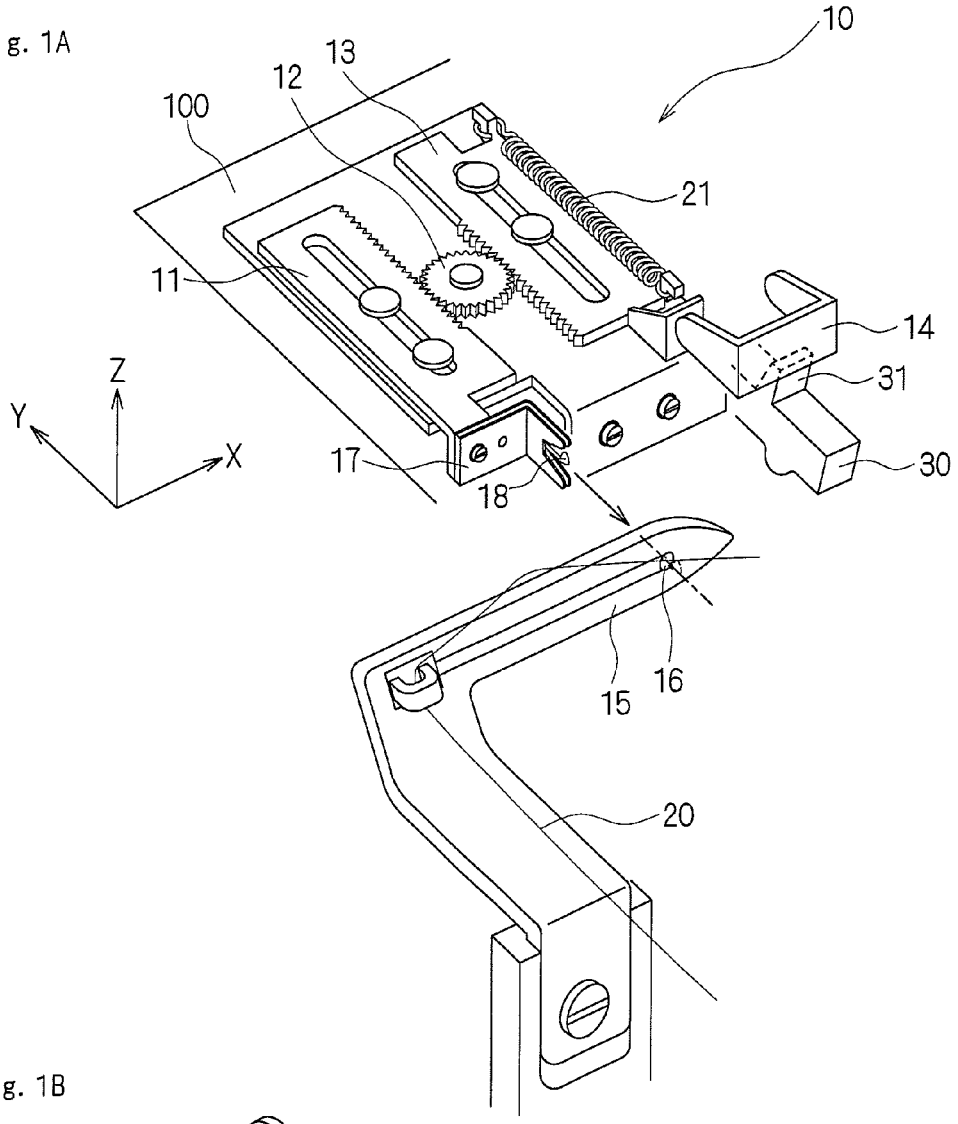
FIGS. 1*a* & 1*b* show perspective views illustrating the configuration of a lower looper threading device according to Embodiment 1 of the present invention.
Figure 1B:
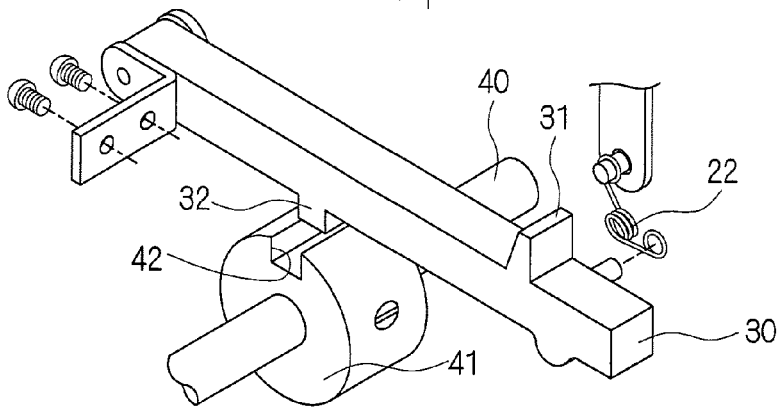
Figure 2:
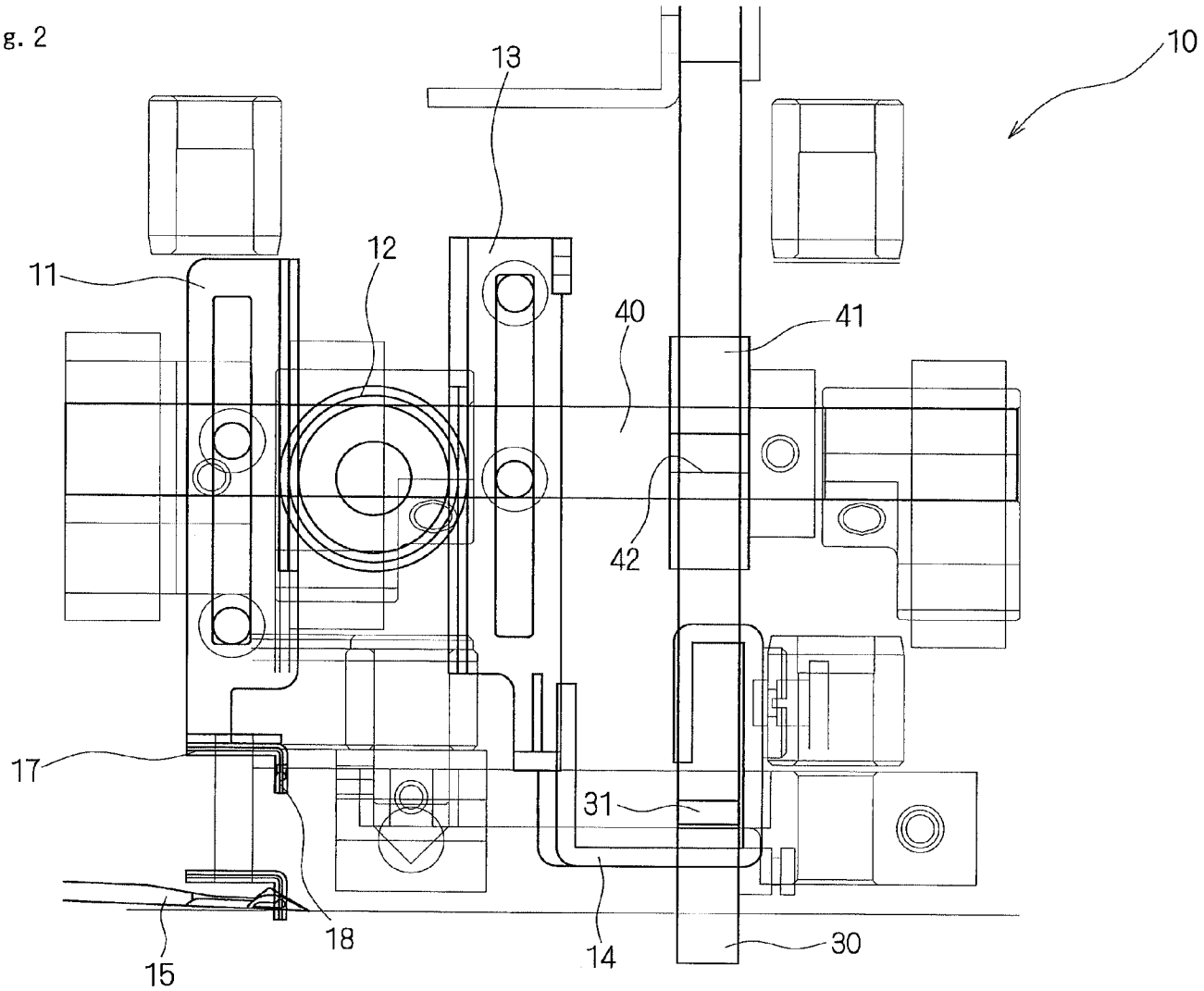
FIG. 2 is a plan view showing the configuration of the lower looper threading device according to Embodiment 1 of the present invention.

FIG. 1 shows perspective views illustrating the configuration of a lower looper threading device 10 according to Embodiment 1 of the present invention. FIG. 2 is a plan view showing the configuration of the lower looper threading device 10 according to Embodiment 1 of the present invention. A lock lever 30 shown in FIG. 1A is actually provided below an operating member 14 in substantially parallel with a second moving member 13 as shown in FIG. 2. FIG. 1B shows members relating to the lock lever 30 independently for easy viewing.

As shown in FIGS. 1A and 1B, the lower looper threading device 10 carries out a threading operation by: inserting a hook part 18 of a threading member 17 fixed to one end of a first moving member 11 into a looper eye 16 of a lower looper 15; hooking, by the hook part 18, a looper thread 20 picked up on the lower looper 15; and drawing out the hook part 18 of the threading member 17 from the looper eye 16. A linear gear is provided on the side surface of the first moving member 11 and meshes with a linear gear provided on the side surface of the second moving member 13 through a rotary gear 12.

The second moving member 13 is connected to an operating member 14 on the same side as the hook part 18 of the first moving member 11 and is biased toward the front side of the Y-axis direction by a spring 21. By pushing the operating member 14 into the back side of the Y-axis direction, the second moving member 13 also is pushed into the back side of the Y-axis direction against the biasing force of the spring 21.

The second moving member 13 is connected to the opposed first moving member 11 through the rotary gear 12. That is, the linear gear is provided on the side surface on the first moving member 11 side of the second moving member 13. When the linear gear meshes with the rotary gear 12 and thereby the second moving member 13 is pushed into the back side of the Y-axis direction, the rotary gear 12 rotates counterclockwise.

Similarly, the linear gear is also provided on the side surface on the second moving member 13 side of the first moving member 11. When the linear gear meshes with the rotary gear 12 and thereby the rotary gear 12 rotates counterclockwise, the first moving member 11 is pushed out to the front side (to the opposite side of the arrow direction of the Y axis shown in FIG. 1) of the Y-axis direction, which is the direction opposite to that in which the second moving member 13 moves. With the first moving member 11 being pushed out to the front side of the Y-axis direction, the threading member 17 fixed to the one end of the first moving member 11 moves toward the front side of the Y-axis direction and thereby the hook part 18 is inserted into the looper eye 16 of the lower looper 15.

After checking that the looper thread 20 picked up on the lower looper 15 is hooked by the hook part 18 inserted into the looper eye 16 of the lower looper 15, the user returns the operating member 14 to the front side of the Y-axis direction. With the operating member 14 being returned to the front side of the Y-axis direction, the second moving member 13 is pulled back to the front side of the Y-axis direction by the biasing force of the spring 21.

When the second moving member 13 is pulled back to the front side of the Y-axis direction, the rotary gear 12 meshes with the linear gear of the second moving member 13 and thereby rotates clockwise. When rotating clockwise, the rotary gear 12 meshes with the linear gear of the first moving member 11 and thereby the first moving member 11 is pulled back to the back side of the Y-axis direction. With the first moving member 11 being pulled back to the back side of the Y-axis direction, the threading member 17 fixed to the one end of the first moving member 11 also moves to the back side of the Y-axis direction. Accordingly, the hook part 18 is pulled out from the looper eye 16 of the lower looper 15 and thereby the looper thread 20 is passed through the looper eye 16 of the lower looper 15.

Figure 3B:
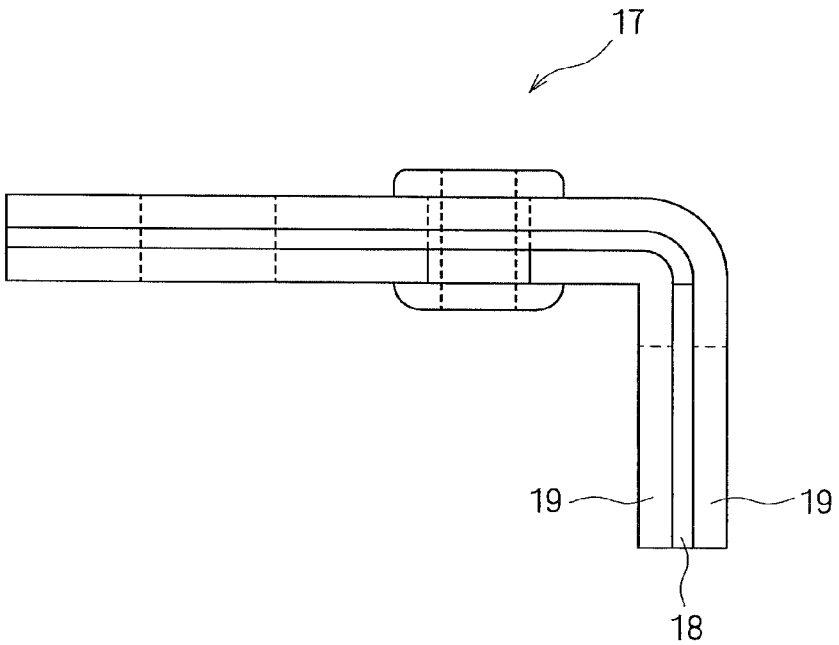
FIGS. 3*a* & 3*b* show a side view and a plan view respectively that illustrate the configuration of a threading member of the lower looper threading device according to Embodiment 1 of the present invention.
Figure 3A:
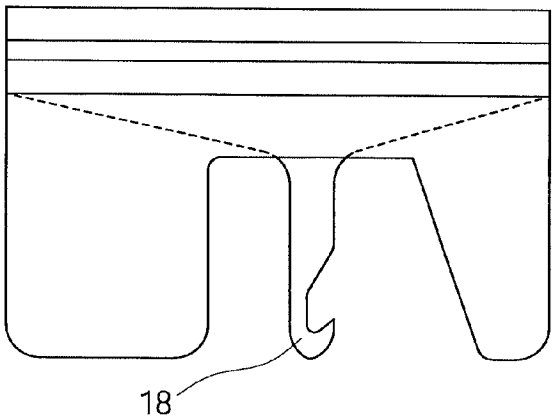

FIG. 3 shows a side view and a plan view that illustrate the configuration of the threading member 17 of the lower looper threading device 10 according to Embodiment 1 of the present invention. FIG. 3A is a side view showing the configuration of the threading member 17 of the lower looper threading device 10 according to Embodiment 1 of the present invention. FIG. 3B is a plan view showing the configuration of the threading member 17 of the lower looper threading device 10 according to Embodiment 1 of the present invention.

In order to allow the looper thread 20, which has been picked up on the lower looper 15, to be hooked easily after the hook part 18 is inserted into the looper eye 16 of the lower looper 15, the threading member 17 is provided with thread picking up parts 19, on which the looper thread 20 is picked up, on both sides of the hook part 18. With the looper thread 20 being picked up on the thread picking up parts 19, the looper thread 20 is hooked by the hook part 18 reliably. Thus, the threading operation can be carried out reliably.

In Embodiment 1, in order to prevent the main shaft 40 from rotating during the threading operation, the main shaft 40 can be locked by the operating member 14 and the lock lever 30. As shown in FIG. 1B and FIG. 2, it is configured in such a manner that the lock lever 30 is provided below the operating member 14 connected to the second moving member 13 and that it is necessary to lock the main shaft 40 with the lock lever 30 in order to push the second moving member 13 connected to the operating member 14 into the back side of the Y-axis direction. The lock lever 30 is biased upward by a torsion spring 22. With the user deliberately preventing the main shaft 40 from rotating, the main shaft 40 cannot rotate.

Figure 4A:
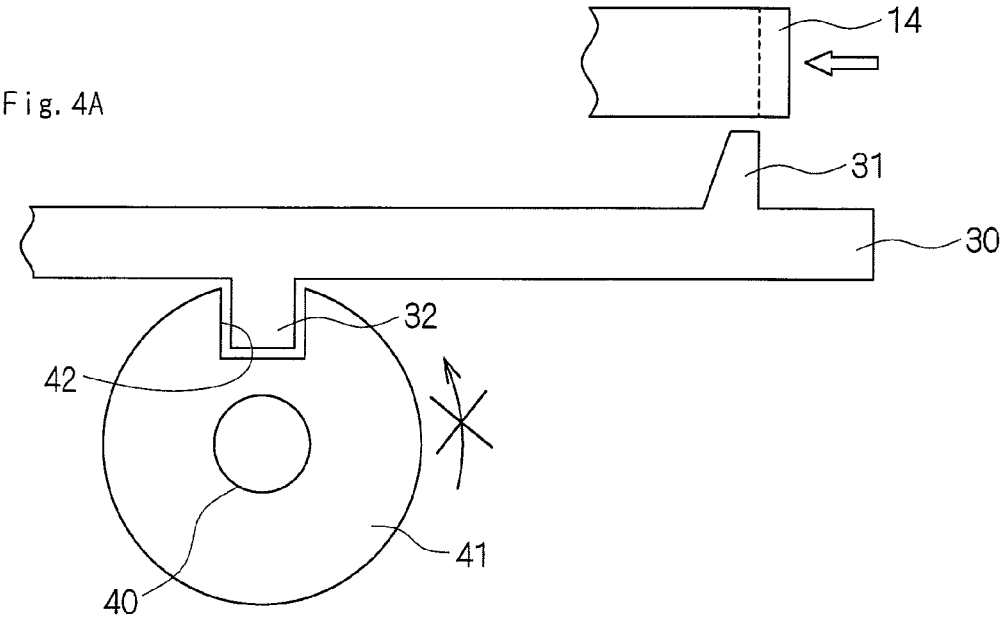
FIGS. 4*a* & 4*b* show schematic views illustrating the movements of a lock lever and an operating member according to Embodiment 1 of the present invention.
Figure 4B:
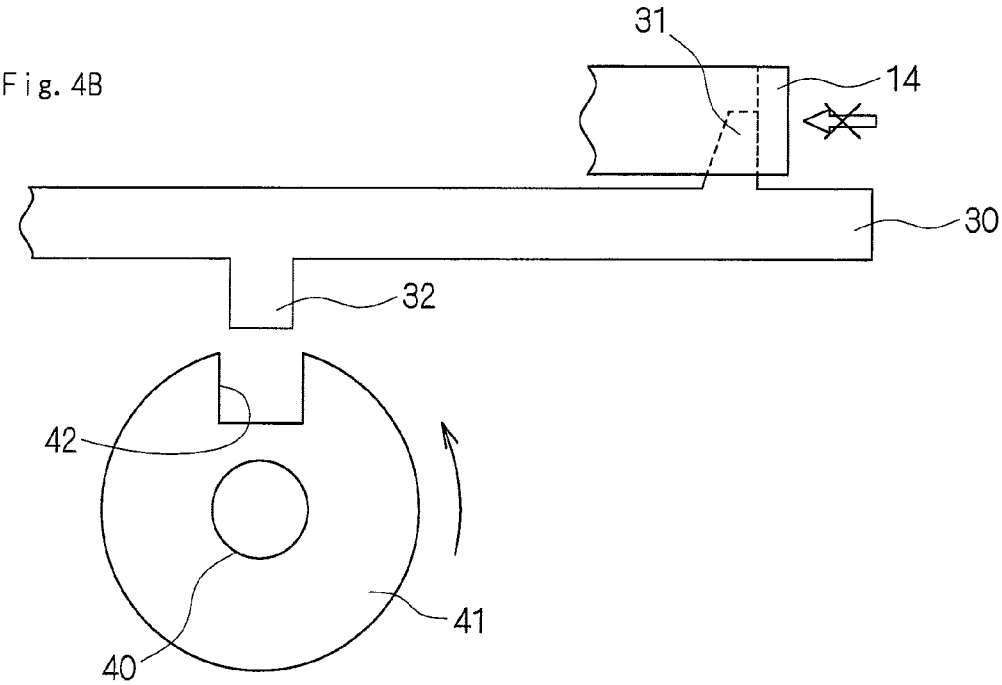

FIG. 4 shows schematic views illustrating the movements of the lock lever 30 and the operating member 14 according to Embodiment 1 of the present invention. FIG. 4A is a schematic view showing the state where the lock lever 30 is locked by the main shaft 40 according to Embodiment 1 of the present invention. FIG. 4B is a schematic view showing the state where the lock lever 30 has been released from the main shaft 40 according to Embodiment 1 of the present invention.

The lock lever 30 is fixed in such a manner that one end thereof can move vertically. Therefore, as shown in FIG. 4A, when the other end of the lock lever 30 is lowered, a convex part 32 provided in the lower part of the lock lever 30 engages with a groove 42 of a groove cam 41 attached to the main shaft 40. With the convex part 32 of the lock lever 30 engaging with the groove 42, the main shaft 40 cannot rotate.

At the same time, a protruding part 31 provided in the upper part of the lock lever 30 moves to be separated from the operating member 14. Therefore, the operating member 14 is not restricted by the protruding part 31 and thereby the second moving member 13 can be pushed into the back side of the Y-axis direction, which allows the threading operation to be carried out.

As shown in FIG. 4B, when the other end of the lock lever 30 is lifted, the convex part 32 provided in the lower part of the lock lever 30 is released from the groove 42 of the groove cam 41 attached to the main shaft 40. When the convex part 32 of the lock lever 30 is released from the groove 42, the main shaft 40 can rotate.

At the same time, the protruding part 31 provided in the upper part of the lock lever 30 moves to come into contact with the operating member 14. Accordingly, the operating member 14 is restricted by the protruding part 31 and therefore the second moving member 13 can be pushed into the back side of the Y-axis direction. Thus, when the main shaft 40 can rotate, the threading operation cannot be carried out.

As described above, according to Embodiment 1, when the operation of threading the lower looper 15 is carried out, the main shaft 40 is prevented from rotating without fail. Thus, the lower looper threading device 10 can be prevented from being damaged due to, for example, oscillation of the lower looper 15 caused by the rotation of the main shaft 40. Furthermore, it is not necessary to detect the position of the lower looper 15 and therefore it is enough for the whole device to have a simple configuration, which allows the cost of the device to be reduced.

Embodiment 2

Since the mechanism itself of a lower looper threading device is the same as that of Embodiment 1, the same numbers are used and the detailed descriptions thereof are not repeated. Embodiment 2 is different from Embodiment 1 in that in order to prevent a main shaft 40 from rotating during a threading operation, the main shaft 40 is locked by a lock lever 30 and an operation dial capable of rotating.

Figure 5:
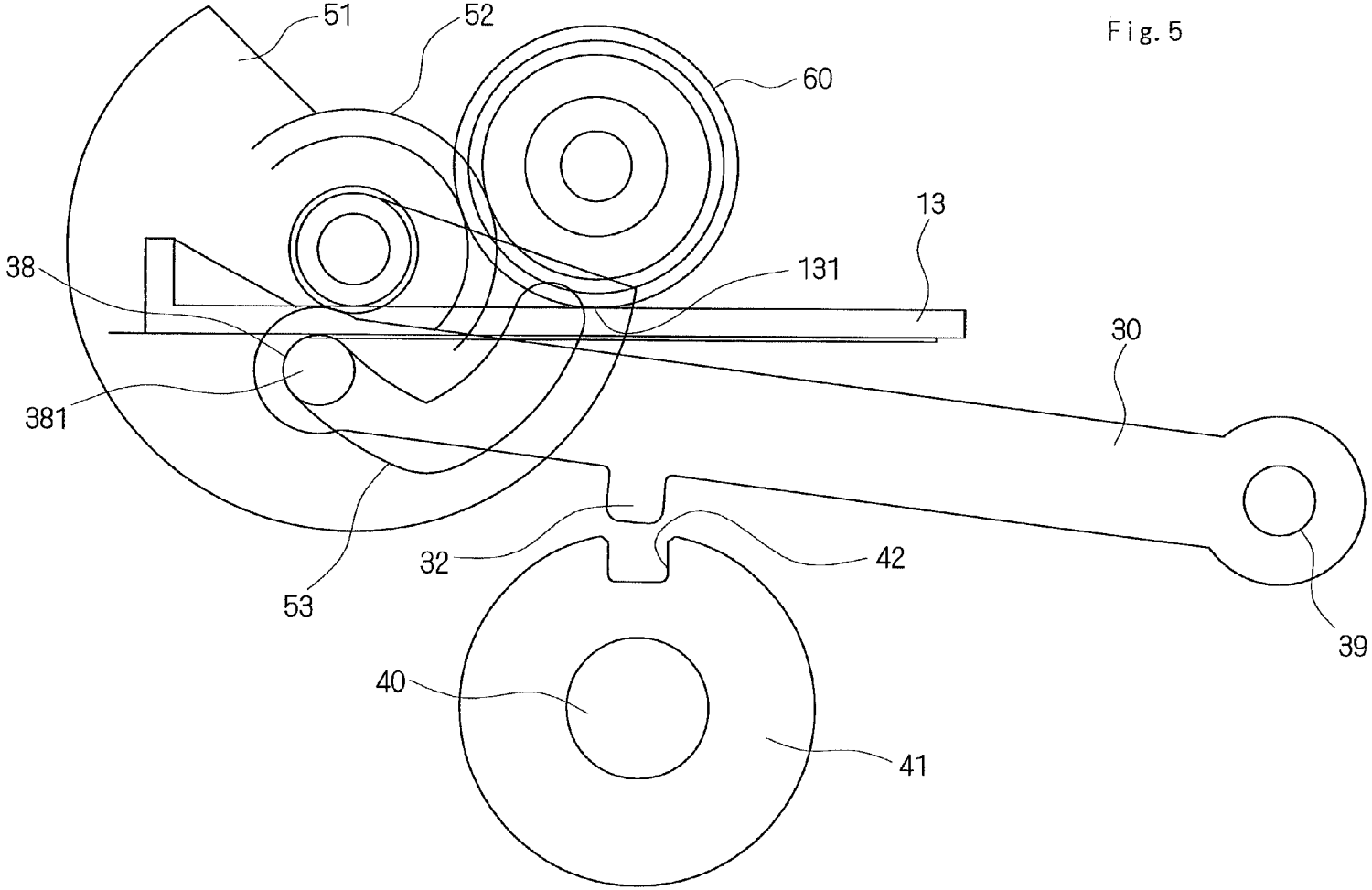
FIG. 5 is a side view showing the positional relationship between a lock lever and a second moving member of a lower looper threading device according to Embodiment 2 of the present invention.

FIG. 5 is a side view showing the positional relationship between the lock lever 30 and a second moving member 13 of the lower looper threading device 10 according to Embodiment 2 of the present invention. As shown in FIG. 5, the lock lever 30 is fixed in such a manner that one end 39 side thereof can move vertically. The operation dial 51 is provided on the other end 38 side of the lock lever 30 and has a gear part 52 and a substantially doglegged cam hole 53.

A protruding part 381 provided on the other end 38 side of the lock lever 30 is inserted into the cam hole 53. Rotation of the operation dial 51 lowers the other end 38 side of the lock lever 30 and thereby a convex part 32 provided in the lower part of the lock lever 30 engages with a groove 42 of a groove cam 41 attached to the main shaft 40. With the convex part 32 of the lock lever 30 engaging with the groove 42, the main shaft 40 cannot rotate.

In this state, further the operation dial 51 is rotated and thereby the second moving member 13 is pushed into the back side of the Y-axis direction shown in FIG. 1, which allows the threading operation to be carried out. Since the order of the threading operation is the same as that in Embodiment 1, detailed descriptions thereof are not repeated.

Figure 6A:
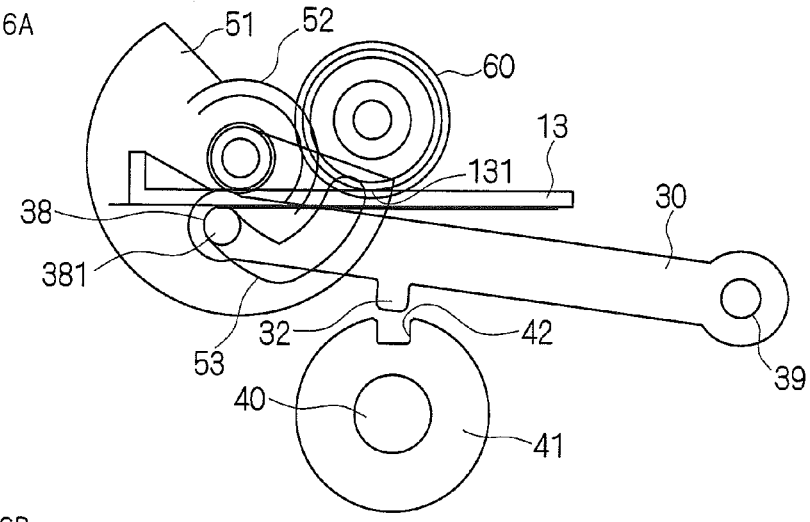
FIGS. 6*a*, 6*b* and 6*c* show schematic views illustrating the movements of the lock lever and the second moving member of the lower looper threading device according to Embodiment 2 of the present invention.

FIG. 6 shows schematic views illustrating the movements of the lock lever 30 and the second moving member 13 of the lower looper threading device 10 according to Embodiment 2 of the present invention. As shown in FIG. 6A, the cam hole 53 of the operation dial has a substantially doglegged shape, and in the initial state thereof, the protruding part 381 on the other end 38 side of the lock lever 30 is located at the left end of the cam hole 53. In this state, the convex part 32 provided in the lower part of the lock lever 30 has been released from the groove 42 of the groove cam 41 attached to the main shaft 40 and therefore the main shaft 40 can rotate.

Figure 6B:
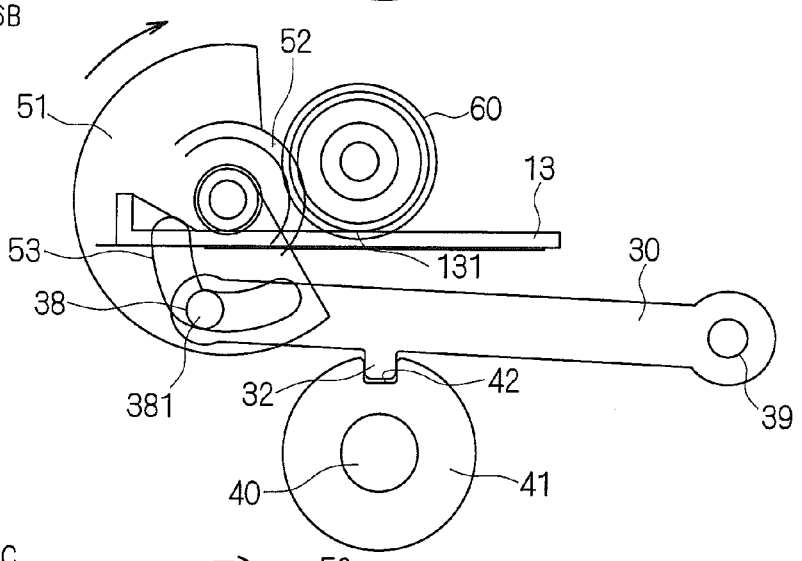
Figure 6C:
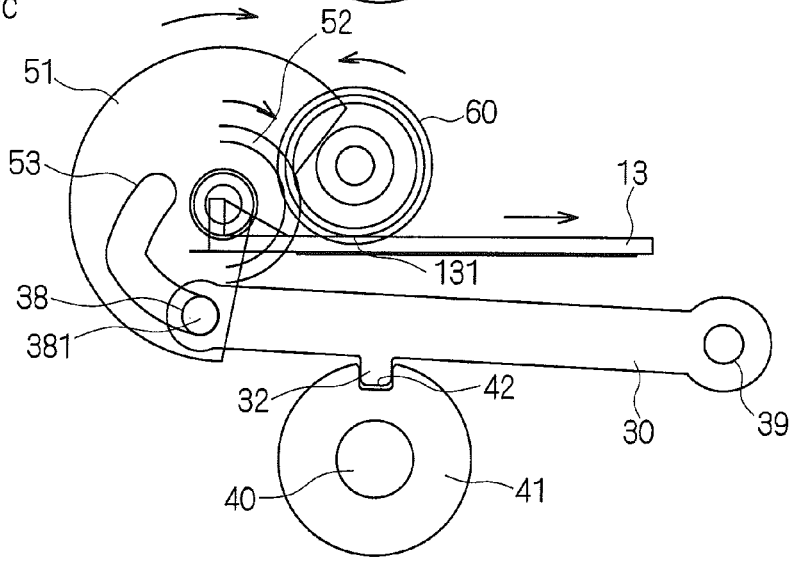

In order to carry out the threading operation, the operation dial 51 is rotated clockwise. FIG. 6B shows the state where the other end 38 side of the lock lever 30 has been lowered. That is, as shown in FIG. 6B, when the protruding part 381 on the other end 38 side of the lock lever 30 moves from the left end along the cam hole 53 and is lowered to a midway point of the substantially doglegged shape of the cam hole 53, the convex part 32 provided in the lower part of the lock lever 30 engages with the groove 42 of the groove cam 41 attached to the main shaft 40. With the convex part 32 of the lock lever 30 engaging with the groove 42 of the groove cam 41 attached to the main shaft 40, the main shaft 40 cannot rotate.

Furthermore, when the operation dial 51 is rotated clockwise, the gear part 52 of the operation dial 51 meshes with an intermediate gear 60 and the intermediate gear 60 rotates counterclockwise. When the intermediate gear 60 rotates counterclockwise, the second moving member 13 having, at the upper surface thereof, a gear part 131 that meshes with the intermediate gear 60 is pushed in the right direction shown in FIG. 6C, that is, to the back side of the Y-axis direction shown in FIG. 1. Thus, the threading operation can be carried out.

As described above, according to Embodiment 2, when the operation of threading the lower looper 15 is carried out, the main shaft 40 is prevented from rotating without fail. Thus, the lower looper threading device 10 can be prevented from being damaged due to, for example, oscillation of the lower looper 15 caused by the rotation of the main shaft 40. Furthermore, it is not necessary to detect the position of the lower looper 15 and therefore it is enough for the whole device to have a simple configuration, which allows the cost of the device to be reduced.

In addition to the above, the present invention can be carried out, with the above-described embodiments being altered variously without departing from the spirit of the present invention. For example, the moving mechanism of the threading member 17 is not particularly limited to that composed of the first moving member 11, the rotary gear 12, and the second moving member 13 as long as the mechanism can move the threading member 17 when the rotation of the main shaft 40 is stopped.

DESCRIPTIONS OF NUMBERS

10 Lower Looper Threading Device
11 First Moving Member
13 Second Moving Member
14 Operating Member
15 Lower Looper
16 Looper Eye
17 Threading Member
18 Hook Part
30 Lock Lever
31, 381 Protruding Part
32 Convex Part
40 Main Shaft
41 Groove Cam
42 Groove
51 Operation Dial
53 Cam Hole
100 Needle Plate

The invention claimed is:

1. A threading device for a sewing machine lower looper that passes a looper thread through a looper eye of the lower looper on the underside of a needle plate, comprising:

a first moving member with a threading member fixed to one end thereof, with the threading member having a hook part that can be inserted into the looper eye of the lower looper;

a second moving member that is connected to the first moving member in such a manner as to be able to move in a direction opposite to that in which the first moving member moves, with an operating member being connected thereto on the same side as the hook part; and a lock lever having, in a lower part thereof, a convex part that engages with a groove of a groove cam attached to a main shaft and, in an upper part thereof, a protruding part that comes into contact with the operating member, wherein when the convex part of the lock lever engages with the groove, the operating member and the protruding part of the lock lever are separated from each other, which prevents movement of the second moving member from being restricted.

2. The threading device for a sewing machine lower looper according to claim 1, wherein the lock lever is fixed in such a manner that one end thereof can move vertically, and when the other end is lowered, the convex part engages with the groove and thereby the operating member and the protruding part are separated from each other, which allows the second moving member to be capable of moving, and when the other end is lifted, the convex part is released from the groove and thereby the operating member and the protruding part come into contact with each other to restrict movement of the second moving member.

3. A threading device for a sewing machine lower looper that passes a looper thread through a looper eye of the lower looper on the underside of a needle plate, comprising:

a first moving member with a threading member fixed to one end thereof, with the threading member having a hook part that can be inserted into the looper eye of the lower looper;

a second moving member that is connected to the first moving member in such a manner as to be able to move in a direction opposite to that in which the first moving member moves, with an operation dial capable of rotating being connected thereto on the same side as the hook part; and a lock lever that has, in a lower part thereof, a convex part that engages with a groove of a groove cam attached to a main shaft, that is fixed in such a manner that one end thereof can move vertically, that moves the other end vertically according to rotation of the operation dial, and that has the operation dial at an end thereof, wherein the operation dial has a hole cam mechanism that is connected to the other end of the lock lever and can move the other end vertically, and the rotation of the operation dial allows the second moving member to move, with the convex part engaging with the groove.

* * * * *